US012179973B2

(12) United States Patent
Hauptman et al.

(10) Patent No.: US 12,179,973 B2
(45) Date of Patent: Dec. 31, 2024

(54) REFILLABLE DISPENSING CONTAINER FOR MOIST WIPES

(71) Applicants: Jonathan Hauptman, Maplewood, MN (US); Sarah Hauptman, Maplewood, MN (US)

(72) Inventors: Jonathan Hauptman, Maplewood, MN (US); Sarah Hauptman, Maplewood, MN (US)

( * ) Notice: Subject to any disclaimer, the term of this patent is extended or adjusted under 35 U.S.C. 154(b) by 79 days.

(21) Appl. No.: 18/109,909

(22) Filed: Feb. 15, 2023

(65) Prior Publication Data

US 2023/0278763 A1 Sep. 7, 2023

Related U.S. Application Data

(60) Provisional application No. 63/315,352, filed on Mar. 1, 2022.

(51) Int. Cl.

| | |
|---|---|
| ***B65D 51/18*** | (2006.01) |
| ***A47K 10/44*** | (2006.01) |
| ***B65D 25/22*** | (2006.01) |
| ***B65D 83/08*** | (2006.01) |
| *A47K 10/32* | (2006.01) |

(52) U.S. Cl.

CPC ..... *B65D 51/18* (2013.01); *A47K 10/44* (2013.01); *B65D 25/22* (2013.01); *B65D 83/0805* (2013.01); *A47K 2010/3266* (2013.01); *B65D 2251/0018* (2013.01)

(58) Field of Classification Search

CPC ..... A47K 10/44

USPC ..... 221/33–63

See application file for complete search history.

(56) References Cited

U.S. PATENT DOCUMENTS

| | | | | |
|---|---|---|---|---|
| 4,651,895 | A | 3/1987 | Niske et al. | |
| 9,549,646 | B2 | 1/2017 | Ray et al. | |
| 9,889,963 | B2 | 2/2018 | Bechyne | |
| 2011/0011767 | A1* | 1/2011 | Gehring | B65D 83/0811 206/581 |
| 2011/0240514 | A1* | 10/2011 | Bandoh | B65D 43/16 206/494 |
| 2015/0048105 | A1* | 2/2015 | Gordon | B65D 83/0894 221/63 |
| 2015/0053712 | A1* | 2/2015 | Laflin | A47K 10/3818 221/45 |
| 2015/0114984 | A1* | 4/2015 | Mehdizadeh | B65D 47/0871 221/63 |
| 2015/0216378 | A1* | 8/2015 | Fulscher | A47K 10/421 221/45 |

* cited by examiner

*Primary Examiner* — Gene O Crawford
*Assistant Examiner* — Ayodeji T Ojofeitimi
(74) *Attorney, Agent, or Firm* — Asgaard Patent Services, LLC; F. Wayne Thompson, Jr.

(57) ABSTRACT

Disclosed is a refillable dispensing container for moist wipes. An example refillable dispensing container comprises a housing defining an interior compartment accessible through an opening in the housing, a lid configured to cover the opening to the interior compartment of the housing, and an inner cover configured to be removably positioned within the opening to the interior compartment of the housing. The lid can be removed to provide access to the inner cover. The inner cover includes a dispensing orifice through which individual wipes can be extracted from the interior compartment of the housing.

13 Claims, 9 Drawing Sheets

REFILLABLE DISPENSING CONTAINER FOR MOIST WIPES

CROSS-REFERENCE TO RELATED APPLICATION(S)

This application claims the benefit of U.S. Provisional Application Ser. No. 63/315,352, filed on Mar. 1, 2022, the entirety of which is incorporated herein by reference.

TECHNICAL FIELD

This disclosure relates to implementations of a refillable dispensing container for moist wipes.

BACKGROUND

Wipes dispensers are in widespread use to provide wipes for various applications. Wipes dispensers typically include a container for holding a plurality of wipes that are individually dispensed through an aperture in the container. The plurality of wipes may be providing on a roll, with individual wipes being defined between perforations in the roll. The plurality of wipes might also be provided as individual wipes interleaved together. The perforated roll and interleaved structures are provided so that pulling a lead wipe through a dispensing aperture in the container will cause another wipe to follow, and, once the lead wipe is removed and separated from the following wipe, the following wipe remains accessible, becoming the new lead wipe to thereafter be removed when desired.

Moist wipes, also known as wet wipes, are commonly used when diapering, but are increasingly being used for non-diapering purposes, such as cleaning of the face and hands, cleaning of high-touch surfaces, and cleaning up messes. As such, a portable wipes dispenser that is ready to hand would be desirable. However, conventional wipes dispensers have typically been designed to be positioned on a flat surface, such as a countertop or table, and are often not convenient to carry or refillable.

Accordingly, needs exist for the refillable dispensing container for moist wipes disclosed herein. It is to the provision of a refillable dispensing container for moist wipes configured to address these needs, and others, that the present invention is primarily directed.

SUMMARY OF THE INVENTION

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is a refillable dispensing container for moist wipes. An example refillable dispensing container comprises a housing defining an interior compartment accessible through an opening in the housing, a lid configured to cover the opening to the interior compartment of the housing, and an inner cover configured to be removably positioned within the opening to the interior compartment of the housing. The lid can be removed to provide access to the inner cover. The inner cover includes a dispensing orifice through which individual wipes can be extracted from the interior compartment of the housing. The inner cover also includes two locating tabs configured to secure the inner cover within the opening to the interior compartment of the housing. Each of the two locating tabs extending from a portion of the inner cover configured to deflect inward when the two locating tabs are pressed together.

Another example refillable dispensing container comprises: a housing comprising a base, a front sidewall spaced apart from a rear sidewall, and a right sidewall spaced apart from a left sidewall, the base and all the sidewalls collectively define an interior compartment accessible through an opening in the housing; a lid configured to cover the opening to the interior compartment of the housing; and an inner cover configured to be removably positioned within the opening to the interior compartment of the housing. The lid can be removed to provide access to the inner cover. The inner cover includes a dispensing orifice through which individual wipes can be extracted from the interior compartment defined by the housing. The inner cover also includes two locating tabs configured to secure the inner cover within the opening to the interior compartment of the housing, the two locating tabs extending from opposing sidewalls of the inner cover. The right sidewall and the left sidewall of the housing each include an opening that extends therethrough, and each opening is configured to receive one of the two locating tabs extending from the inner cover.

Yet another example refillable dispensing container comprises: a housing comprising a base, a front sidewall spaced apart from a rear sidewall, and a right sidewall spaced apart from a left sidewall, the base and all the sidewalls collectively define an interior compartment accessible through an opening in the housing; a lid configured to cover the opening to the interior compartment of the housing; and an inner cover configured to be removably positioned within the opening to the interior compartment of the housing. The lid can be removed to provide access to the inner cover. The inner cover includes a dispensing orifice through which individual wipes can be extracted from the interior compartment defined by the base and sidewalls of the housing. The lid is connected to the inner cover by a living hinge. The rear sidewall of the housing includes a slot configured to accommodate a portion of the living hinge connecting the lid to the inner cover.

BRIEF DESCRIPTION OF THE DRAWINGS

Like reference numerals refer to corresponding parts throughout the several views of the drawings.

DETAILED DESCRIPTION

Figure 1:
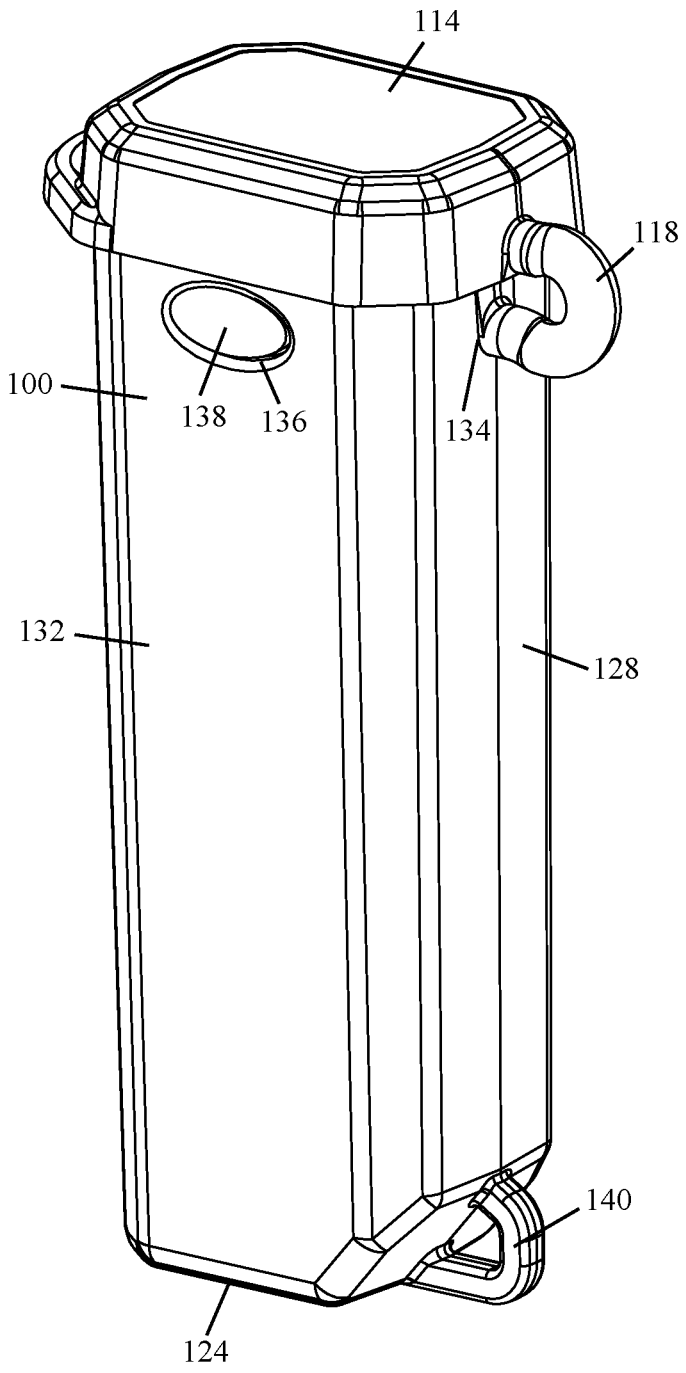
FIG. 1 is a perspective view of a refillable dispensing container for moist wipes according to the principles of the present disclosure.
Figure 2:
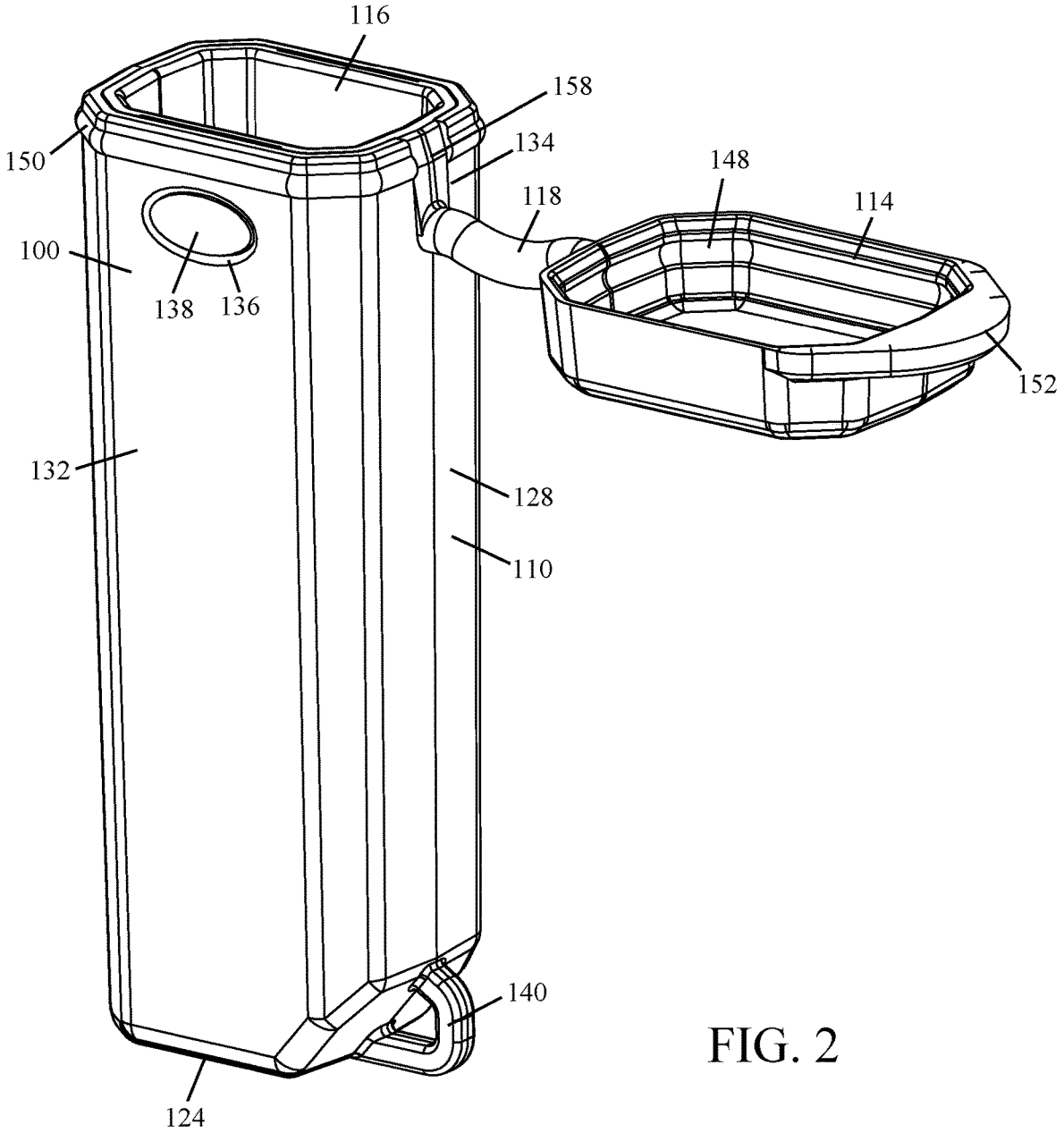
FIG. 2 is another perspective view of the refillable dispensing container for moist wipes shown in FIG. 1.
Figure 3:
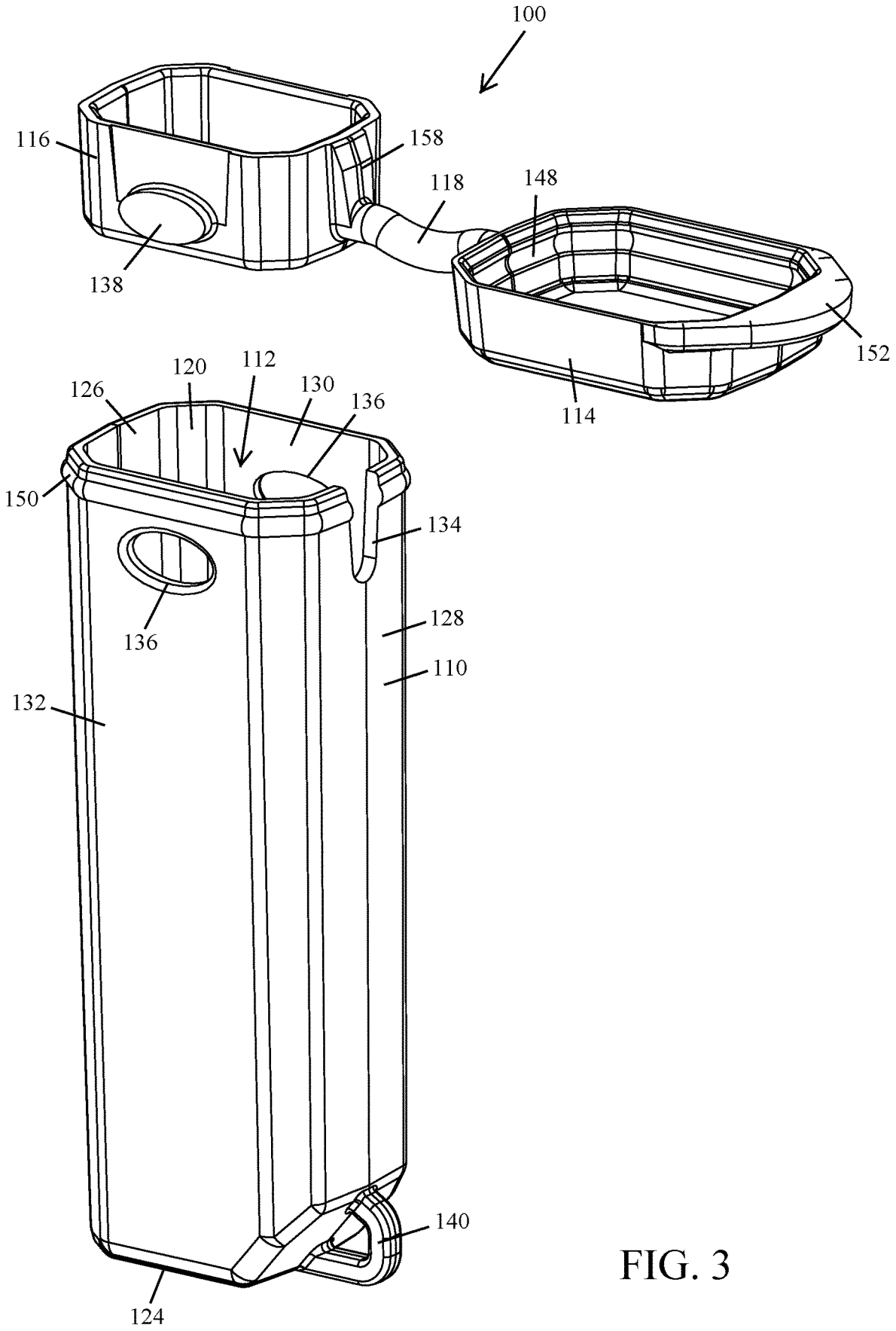
FIG. 3 is an exploded view of the refillable dispensing container for moist wipes shown in FIG. 1.

FIGS. 1-3 illustrate an example refillable dispensing container 100 for moist wipes according to the principles of the present disclosure.

As shown in FIGS. 1-3, the refillable dispensing container 100 comprises a housing 110 defining an interior compartment 112 for storing wipes, and a lid 114 connected to an inner cover 116 by a flexible hinge 118. The inner cover 116 is configured to be removably positioned within an opening 120 into the interior compartment 112 of the housing 110, and includes a dispensing orifice 122 through which individual wipes can be extracted (i.e., dispensed) from the interior compartment 112. By providing access to the interior compartment 112 via the removable inner cover 116 and lid 114, the refillable dispensing container 100 can be refilled with a new stack of wipes after the previous stack of wipes has been consumed.

Figure 4:
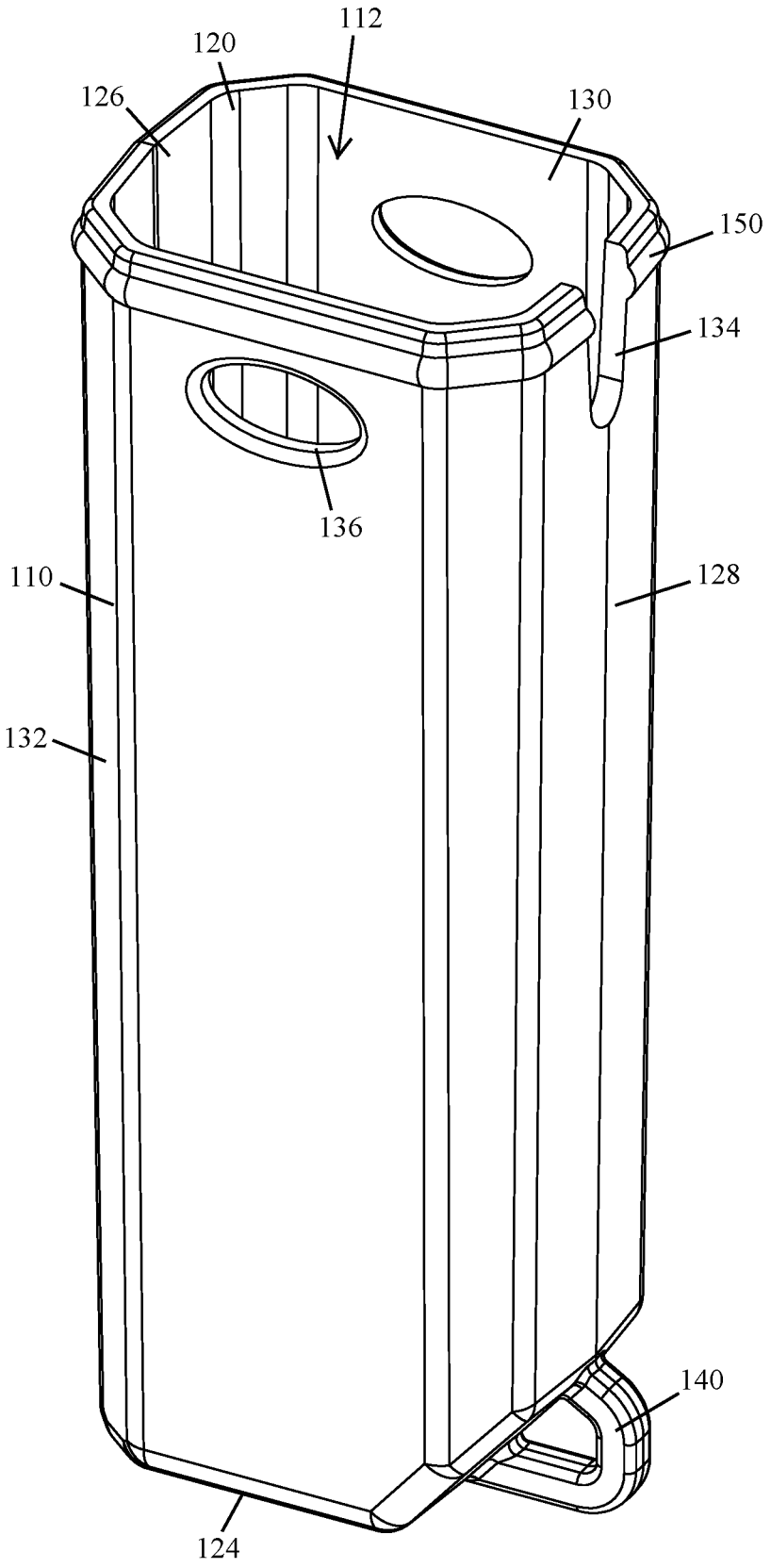
FIG. 4 is a perspective view of the housing of the refillable dispensing container for moist wipes shown in FIG. 1.

As shown best in FIGS. 3 and 4, the housing 110 comprises a base 124 connected to a front sidewall 126, a rear sidewall 128, a right sidewall 130, and a left sidewall 132. The base 124 and sidewalls (126, 128, 130, 132) of the housing 110 define the interior compartment 112. A plurality of wipes can be stored in the interior compartment 112 in a stacked fashion and in a vertical orientation. However, it is contemplated that the interior compartment 112 can alternatively be configured to store the plurality of wipes in a rolled fashion. The rear sidewall 128 includes a slot 134 configured to accommodate a portion of the flexible hinge 118 (see, e.g., FIG. 2). The right sidewall 130 and the left sidewall 134 each include an opening 136 that extends therethrough. Each opening 136 is configured to receive a locating tab 138 extending from a sidewall (154 and 156) of the inner cover 116.

Figure 5:
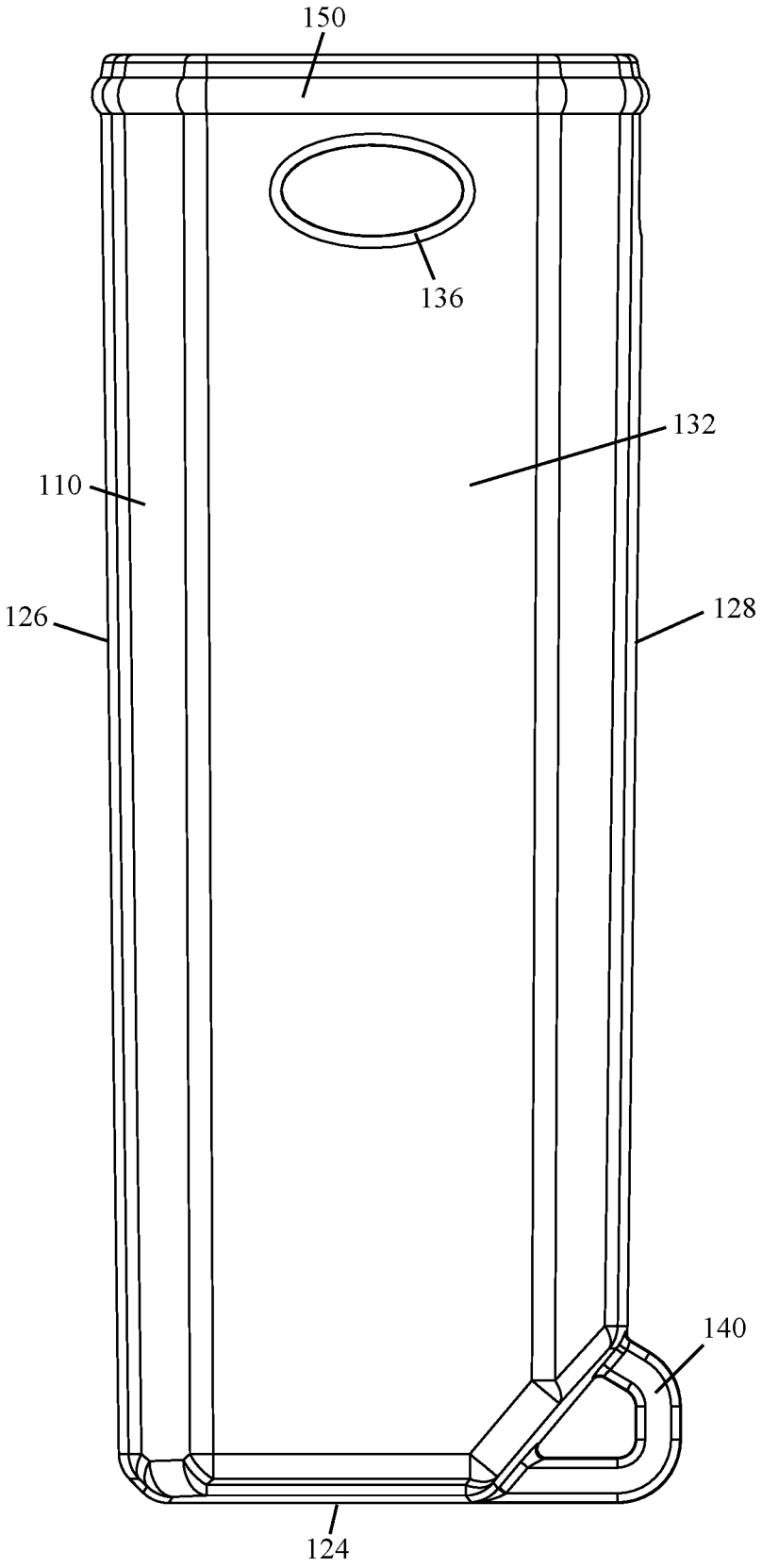
FIG. 5 is a side elevational view of the housing shown in FIG. 4.
Figure 6:
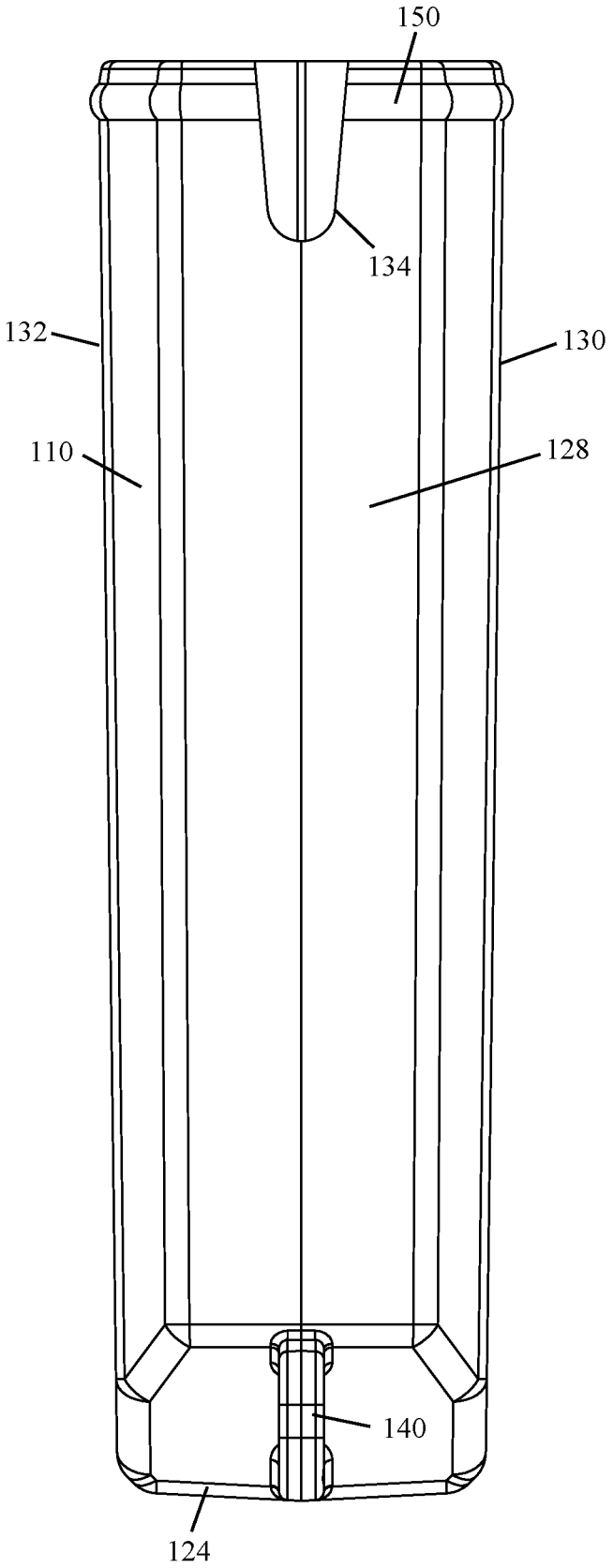
FIG. 6 is a back side elevational view of the housing shown in FIG. 4.

The housing 110 may include a connection member 140 (see, e.g., FIG. 5). The connection member 140 is a loop extending between the base 124 and the rear sidewall 128 of the housing 110. The loop 140 is configured (i.e., shaped and sized) so that a key ring, a lanyard, etc. can be inserted through the loop 140 to enable convenient carrying or attachment to a person or personal article (e.g., a purse, keychain, or backpack). The housing 110 is formed as a single piece. However, in some implementations, the housing 110 may be separate pieces attached together.

As shown in FIG. 1, the lid 114 can be used to cover the opening 120 into the interior compartment 112 of the housing 110. In this way, the refillable dispensing container 100 can be sealed when not being used. More specifically, the lid 114 and housing 110 are configured to snap together via a rib-and-recess relationship. In the preferred embodiment, the lid 114 includes an internal circumferential recess 148 configured to engage with a rib 150 extending about the exterior of the housing 110 (see, e.g., FIG. 2). The lid 114 also includes a lip 152 used to lift the lid 114 from the housing 110 to access wipes stored therein.

Figure 7:
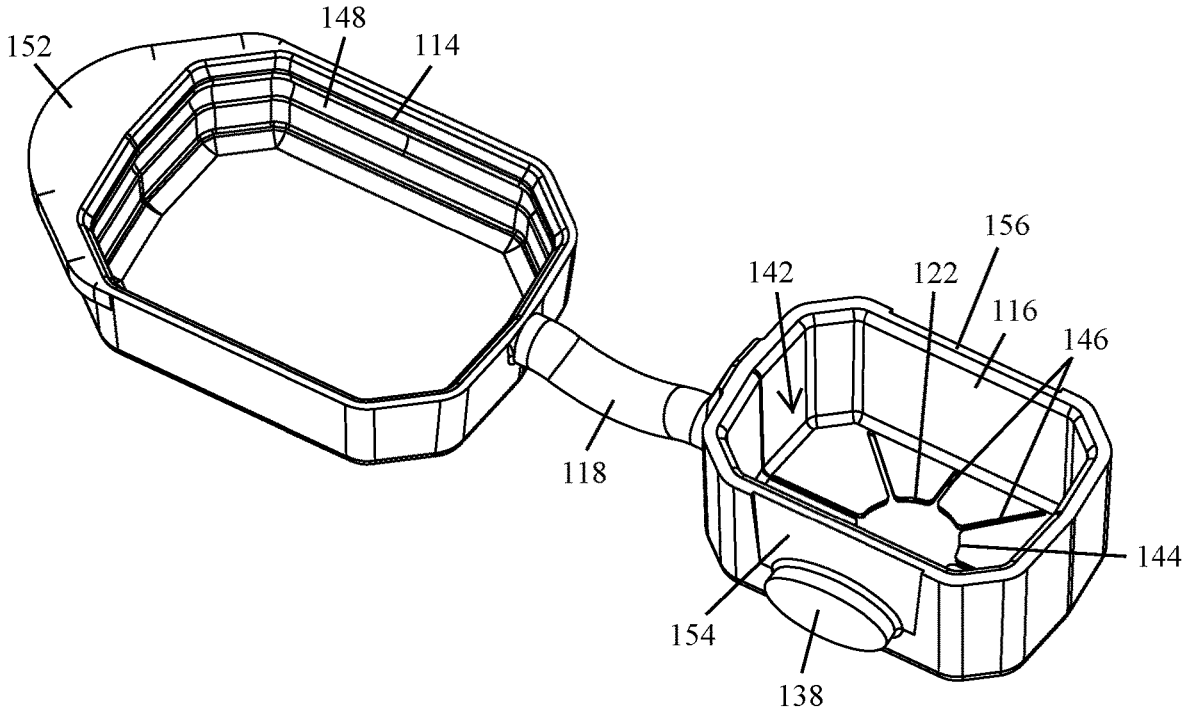
FIG. 7 is a perspective view of the inner cover and lid of the refillable dispensing container for moist wipes shown in FIG. 1.
Figure 8:
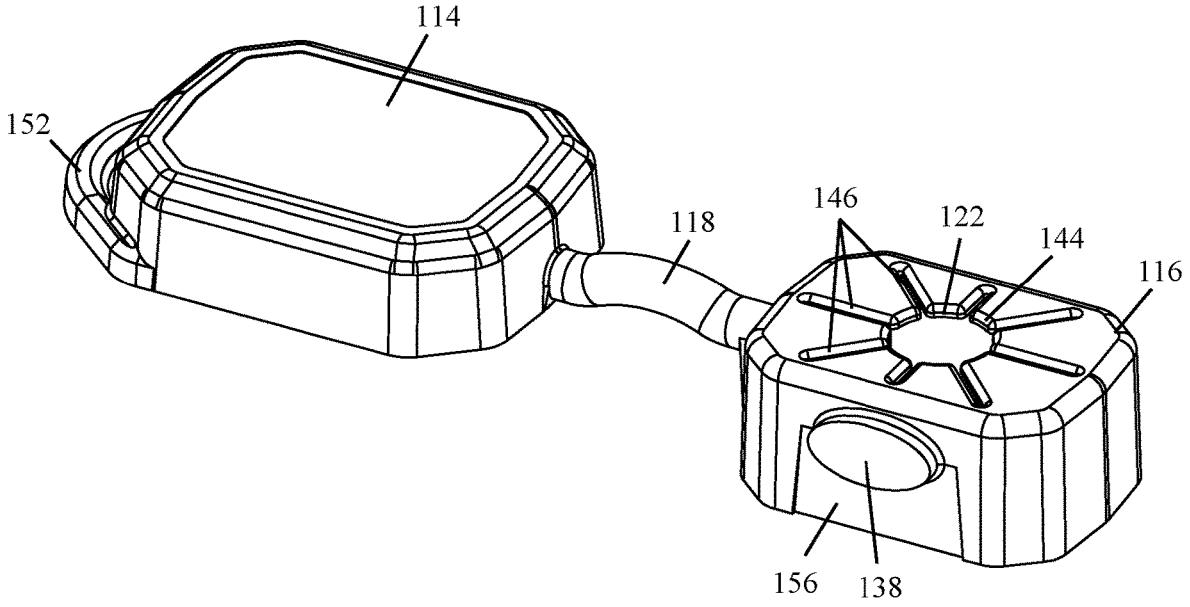
FIG. 8 is another perspective view of the inner cover and lid shown in FIG. 7.
Figure 9:
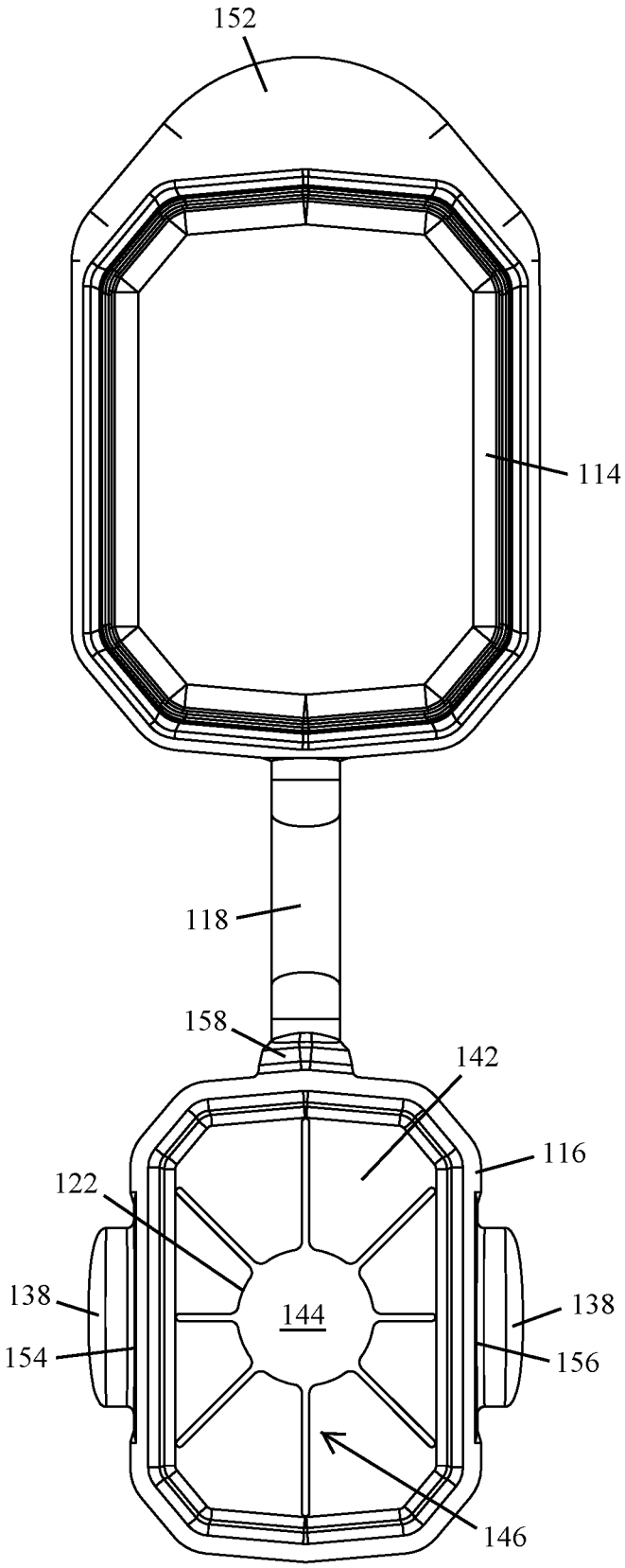
FIG. 9 is a top plan view of the inner cover and lid shown in FIG. 7.

As shown best in FIGS. 7-9, the inner cover 116 comprises the dispensing orifice 122 and the two locating tabs 138 used to removably secure the inner cover 116 within the opening 120 into the interior compartment 112 of the housing 110.

The dispensing orifice 122 of the inner cover 116 is configured to provide a user access to the wipes stored within the interior compartment 112 of the housing 110, and it is through the dispensing orifice 122 that the wipes are removed from the housing 110 and separated one from the other. As shown best in FIG. 7, the dispensing orifice 122 is defined in a recessed surface 142 of the inner cover 116. The dispensing orifice 122 comprises a generally circular opening 144 having a plurality of radially disposed slits 146 extending therefrom. In this way, the dispensing orifice 122 acts as a wipe separator.

The locating tabs 138 extend from opposing sidewalls 154, 156 of the inner cover 116. In particular, one locating tab 138 extends from the right sidewall 154 and the other locating tab 138 extends from the left sidewall 156. Each locating tab 138 extends from a portion of the sidewall (154, 156) that is flexible, and configured to inwardly deflect when pressed. Accordingly, by squeezing the locating tabs 138 together, the inner cover 116 can be positioned within, and removed from, the opening 120 into the interior compartment 112 of the housing 110 by a user. Each of the locating tabs 138 is located, sized, and shaped so as to fit into, and be received by, the corresponding opening 136 in the right sidewall 130 and the left sidewall 132 of the housing 110 (see, e.g., FIG. 2). As shown in FIGS. 8 and 9, in the preferred embodiment, each locating tab 138 is an elliptical cylinder (i.e., a cylinder with an elliptical cross section). However, it should be understood that, each locating tab 138 could have another shape (e.g., a cylinder).

As shown best in FIGS. 2 and 3, the inner cover 116 may include a plug 158 configured to fill the portion of the slot 134 in the rear sidewall 128 of the housing 110 not occupied by the flexible hinge 118.

As shown in FIGS. 7-9, the flexible hinge 118, a living hinge, is a cylindrical length of material extending between the lid 114 and the inner cover 116. However, the flexible hinge 118 could have a non-cylindrical shape. The flexible hinge 118 allows the lid to bend relative to the inner cover 116 (see, e.g., FIGS. 1 and 2).

The housing 110, lid 114, inner cover 116, and flexible hinge 118 can be manufactured using any suitable technique such as injection molding, additive manufacturing (3D printing), or the like. The housing 110, lid 114, inner cover 116, and flexible hinge 118 are made of a suitably durable and resilient polymer material.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A refillable dispensing container for moist wipes, the refillable dispensing containing comprising:

a housing defining an interior compartment accessible through an opening in the housing;

a lid configured to cover the opening to the interior compartment of the housing; and an inner cover configured to be removably positioned within the opening to the interior compartment of the housing;

wherein:

the lid can be removed to provide access to the inner cover;

the inner cover includes a dispensing orifice through which individual wipes can be extracted from the interior compartment of the housing; and the inner cover also includes two locating tabs configured to secure the inner cover within the opening to the interior compartment of the housing, each of the two locating tabs extending from a portion of the inner cover configured to deflect inward when the two locating tabs are pressed together.

2. The refillable dispensing container of claim 1, wherein the dispensing orifice is defined in a recessed surface of the inner cover and comprises a generally circular opening having a plurality of radially disposed slits extending therefrom.

3. The refillable dispensing container of claim 1, wherein the lid is connected to the inner cover by a living hinge.

4. The refillable dispensing container of claim 3, wherein the lid, the inner cover, and the living hinge are a unitary piece.

5. A refillable dispensing container for moist wipes, the refillable dispensing containing comprising:

a housing comprising a base, a front sidewall spaced apart from a rear sidewall, and a right sidewall spaced apart from a left sidewall, the base and all the sidewalls collectively define an interior compartment accessible through an opening in the housing;

a lid configured to cover the opening to the interior compartment of the housing; and an inner cover configured to be removably positioned within the opening to the interior compartment of the housing;

wherein:

the lid can be removed to provide access to the inner cover;

the inner cover includes a dispensing orifice through which individual wipes can be extracted from the interior compartment defined by the base and sidewalls of the housing;

the inner cover also includes two locating tabs configured to secure the inner cover within the opening to the interior compartment of the housing, the two locating tabs extending from opposing sidewalls of the inner cover; and the right sidewall and the left sidewall of the housing each include an opening that extends therethrough, each opening is configured to receive one of the two locating tabs extending from the inner cover.

6. The refillable dispensing container of claim 5, wherein each of the two locating tabs extends from a portion of the inner cover, which is configured to deflect inward when the two locating tabs are pressed together.

7. The refillable dispensing container of claim 5, wherein the dispensing orifice is defined in a recessed surface of the inner cover and comprises a generally circular opening having a plurality of radially disposed slits extending therefrom.

8. The refillable dispensing container of claim 5, wherein the lid is connected to the inner cover by a living hinge.

9. The refillable dispensing container of claim 8, wherein the rear sidewall of the housing includes a slot configured to accommodate a portion of the living hinge connecting the lid to the inner cover.

10. The refillable dispensing container of claim 8, wherein the lid, the inner cover, and the living hinge are a unitary piece.

11. A refillable dispensing container for moist wipes, the refillable dispensing containing comprising:

a housing comprising a base, a front sidewall spaced apart from a rear sidewall, and a right sidewall spaced apart from a left sidewall, the base and all the sidewalls collectively define an interior compartment accessible through an opening in the housing;

a lid configured to cover the opening to the interior compartment of the housing; and an inner cover configured to be removably positioned within the opening to the interior compartment of the housing;

wherein:

the lid can be removed to provide access to the inner cover;

the inner cover includes a dispensing orifice through which individual wipes can be extracted from the interior compartment defined by the base and sidewalls of the housing;

the lid is connected to the inner cover by a living hinge; and the rear sidewall of the housing includes a slot configured to accommodate a portion of the living hinge connecting the lid to the inner cover.

12. The refillable dispensing container of claim 11, wherein the dispensing orifice is defined in a recessed surface of the inner cover and comprises a generally circular opening having a plurality of radially disposed slits extending therefrom.

13. The refillable dispensing container of claim 11, wherein the lid, the inner cover, and the living hinge are a unitary piece.

* * * * *